US007198165B2

(12) United States Patent
Zhang

(10) Patent No.: US 7,198,165 B2
(45) Date of Patent: Apr. 3, 2007

(54) MOLDED PLASTIC HOT-FILL CONTAINER AND METHOD OF MANUFACTURE

(75) Inventor: Qiuchen Peter Zhang, Perrysburg, OH (US)

(73) Assignee: Graham Packaging PET Technologies Inc., York, PA (US)

( * ) Notice: Subject to any disclaimer, the term of this patent is extended or adjusted under 35 U.S.C. 154(b) by 0 days.

(21) Appl. No.: 10/849,971

(22) Filed: May 20, 2004

(65) Prior Publication Data

US 2006/0289378 A1 Dec. 28, 2006

(51) Int. Cl.
*B65D 1/02* (2006.01)
*B65D 1/42* (2006.01)
*B65D 23/00* (2006.01)

(52) U.S. Cl. ..... 215/381; 215/382; 220/669; 220/675

(58) Field of Classification Search ..... 215/381, 215/383, 384, 900, 379, 396, 382; 220/666, 220/669, 675, 771
See application file for complete search history.

(56) References Cited

U.S. PATENT DOCUMENTS

| | | | | |
|---|---|---|---|---|
| 5,067,622 | A | 11/1991 | Garver et al. | |
| 5,413,244 | A | 5/1995 | Ramsey | |
| 5,593,056 | A | 1/1997 | Mero et al. | |
| 5,735,421 | A | 4/1998 | Deemer et al. | |
| 5,762,221 | A | 6/1998 | Tobias et al. | |
| 5,887,739 | A | 3/1999 | Prevot et al. | |
| 5,971,184 | A * | 10/1999 | Krishnakumar et al. | 215/384 |
| 6,585,125 | B1 | 7/2003 | Peek | |
| 6,875,201 | B1 * | 4/2005 | Kawashima et al. | 604/295 |
| 2001/0022291 | A1 * | 9/2001 | Shimada et al. | 215/382 |
| 2002/0008077 | A1 * | 1/2002 | Lane et al. | 215/381 |
| 2002/0104820 | A1 | 8/2002 | Hong et al. | |
| 2003/0136754 | A1 * | 7/2003 | Bourque et al. | 215/384 |
| 2003/0168425 | A1 * | 9/2003 | Yourist | 215/381 |

FOREIGN PATENT DOCUMENTS

| | | | |
|---|---|---|---|
| EP | 0 502 391 A2 | | 9/1992 |
| GB | 2237550 A | | 5/1991 |
| WO | WO 00/50309 | * | 8/2000 |
| WO | WO-01/89934 A2 | | 11/2001 |

OTHER PUBLICATIONS

Patent Abstract of Japan, Publication No. 2000142654, May 23, 2000.

* cited by examiner

*Primary Examiner*—Sue A. Weaver
(74) *Attorney, Agent, or Firm*—Venable LLP; Stuart I. Smith

(57) ABSTRACT

A blow molded plastic hot-fill container includes at least one vacuum panel for inward flexure under vacuum after the container is hot-filled and capped. The vacuum panel is externally concave as viewed in cross section from a first direction and externally convex as viewed in cross section from a second direction orthogonal to the first direction. The at least one vacuum panel preferably is disposed in a sidewall of the container, which preferably is of generally uniform wall thickness, and preferably includes an array of vacuum panels angularly spaced around an axis of the container.

22 Claims, 4 Drawing Sheets

MOLDED PLASTIC HOT-FILL CONTAINER AND METHOD OF MANUFACTURE

The present invention is directed to molded plastic containers that are particularly adapted for hot-fill applications, in which vacuum panels are provided on the container wall to flex inwardly and thereby absorb vacuum pressure as the contents of the container cool.

BACKGROUND AND SUMMARY OF THE INVENTION

In so-called hot-fill packages, a container is filled with hot fluid product and capped while the fluid product is still hot. As the fluid product cools, a reduction in fluid volume creates a vacuum within the package—i.e., an internal pressure that is less than the surrounding atmospheric pressure. When the container is of molded plastic construction, the container wall tends to distort inwardly as the fluid cools. It has been proposed to provide vacuum panel areas on the container wall for controlling the areas of distortion under vacuum. These vacuum panels conventionally are placed in the body portion of the container over which a label subsequently is applied, causing the label undesirably to "crinkle" in a user's hand because of the absence of contact and adhesion entirely around the container wall. It is a general object of the present invention to provide a plastic container and a method of making such a container that are particularly well adapted for use in hot-fill applications, and/or in which vacuum panels are provided in the container wall in an area separate from the label application area, and/or in which the vacuum panels lend an ornamental appearance to the container as a whole, and/or in which the label application area is as large as that of a comparable glass container.

The present invention embodies a number of different aspects, which may be implemented separately from or more preferably in combination with each other.

A blow molded plastic hot-fill container in accordance with a first aspect of the invention includes at least one vacuum panel for inward flexure under vacuum after the container is hot-filled and capped. The vacuum panel is externally concave as viewed in cross section from a first direction and externally convex as viewed in cross section from a second direction orthogonal to the first direction. The at least one vacuum panel preferably is disposed in a sidewall of the container, which preferably is of generally uniform wall thickness, and preferably includes an array of vacuum panels angularly spaced around an axis of the container.

A blow-molded plastic hot-fill container in accordance with a second aspect of the invention includes a base for supporting the container, a body extending from the base, a dome extending from the body and a neck finish extending from the dome. The dome includes an array of vacuum panels, with each of the vacuum panels being externally concave as viewed in cross section from a first direction and externally convex as viewed in cross section from a second direction orthogonal to the first direction. In the preferred embodiment of the invention, the vacuum panels are externally concave as viewed in cross section laterally of the dome, and externally convex in cross section as viewed axially of the dome. The dome, including the array of vacuum panels, preferably is of generally uniform wall thickness, and the vacuum panels preferably have longitudinal axes at acute angles to the central axis of the container neck finish.

A blow-molded plastic hot-fill container in accordance with a third aspect of the invention includes a base for supporting the container, a body extending from the base, a dome extending from the body and a neck finish extending from the dome. The dome includes an array of flexible resilient vacuum panels, with each of the vacuum panels being externally concave as viewed in cross section from a first direction and externally convex as viewed in cross section from a second direction orthogonal to the first direction. The dome, including the array of vacuum panels, preferably is of generally uniform wall thickness and circular in cross section. The body of the container is of cylindrical construction, and includes axially spaced lands for applying a label to the container. Thus, the label is applied to the generally cylindrical body of the container while the vacuum panels are disposed in the dome of the container, so that the label does not overlie the vacuum panels and does not "crinkle" when gripped by a user.

A fourth aspect of the present invention contemplates a method of blow molding a plastic container in accordance with any of the first, second and third aspects of the invention.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
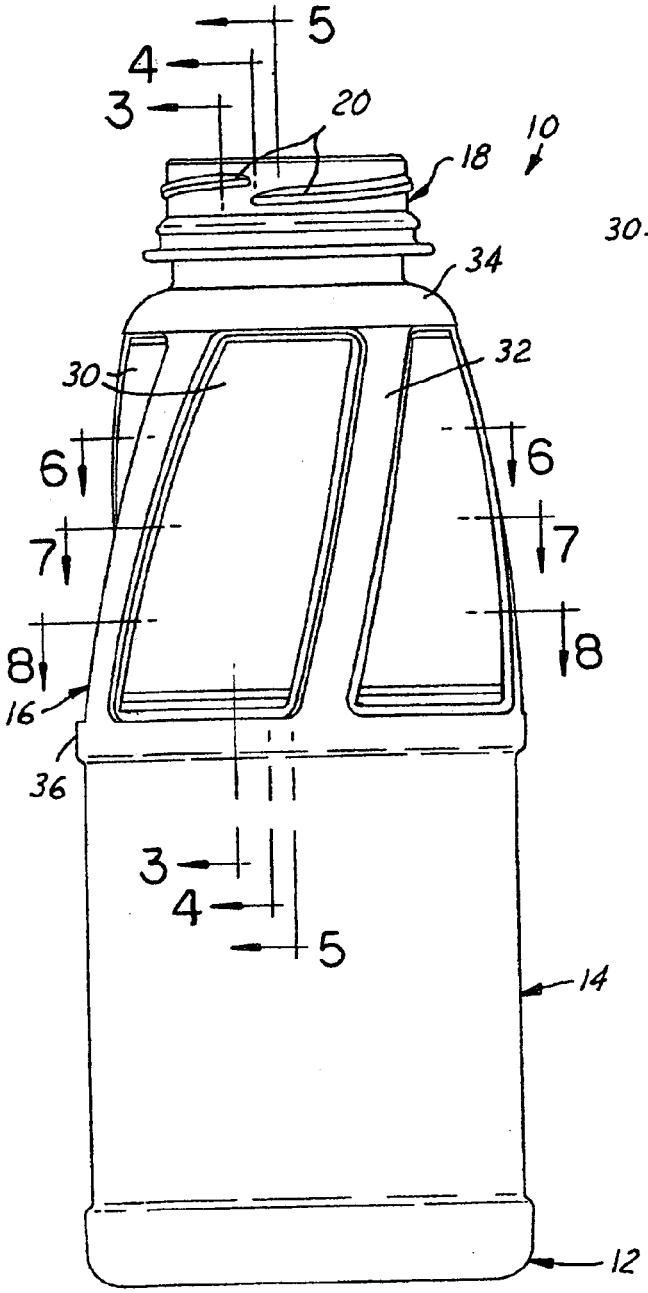
FIG. 1 is an elevational view of a blow-molded plastic hot-fill container in accordance with one presently preferred embodiment of the invention.
Figure 2:
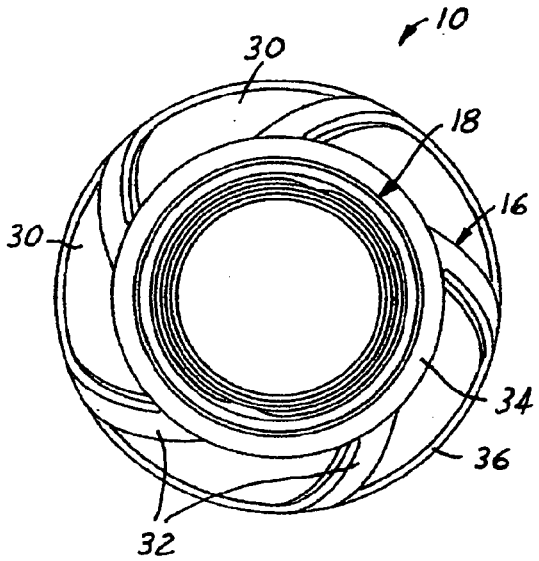
FIG. 2 is a top plan view of the container illustrated in FIG. 1.

FIGS. 1–2 illustrate a container 10 in accordance with one presently preferred embodiment of the invention. Container 10 includes a base 12 for supporting the container, and a body 14 extending upwardly from the base. A dome 16 extends upwardly from body 14, and a neck finish 18 extends upwardly from dome 16. In the illustrated embodiment of the invention, container 10 is generally circular in cross section, with base 12, body 14 and dome 16 being coaxial with the central axis of neck finish 18. (Directional words such as "upwardly" and "downwardly" are used by way of description and not limitation with respect to the upright orientation of the container shown in FIG. 1. Directional words such as "axially" and "radially" are employed by way of description and not limitation with respect to the central axis of the neck finish, which preferably is coaxial with the central axis of the container.) Neck finish 18 is generally cylindrical in geometry, and has one or more external attachment features, preferably external thread or thread segments 20, for attaching a closure to the container. Body 14 is generally cylindrical in construction, preferably having an external periphery that is recessed or stepped radially inwardly from the peripheries of base 12 and dome 16.

Dome 16 has an array of vacuum panels 30 circumferentially spaced from each other, preferably equidistantly spaced, around the circumference of dome 16. Vacuum panels 30 are flexible and resilient, and are separated from each other by a circumferentially spaced plurality of ribs 32. The external surfaces of ribs 32 lie on a common surface of revolution around the axis of neck finish 18, with vacuum panels 30 being recessed radially inwardly from this external surface of revolution. As best seen in FIG. 1, each of the panels 30 has a longitudinal axis at an acute angle to the central axis of neck finish 18, and ribs 32 are also angulated with respect to the central axis of the neck finish. Ribs 32 are identical to each other, as are vacuum panels 30. Ribs 32 join annular rings 34, 36 at the top and bottom of dome 16 to form a relatively rigid frame, within which panels 30 form relatively flexible resilient windows. Dome 16 is generally conical in the illustrated embodiment of the invention, and ribs 32 preferably are of uniform width. Vacuum panels 30 thus taper slightly in width from bottom to top.

Figure 5:
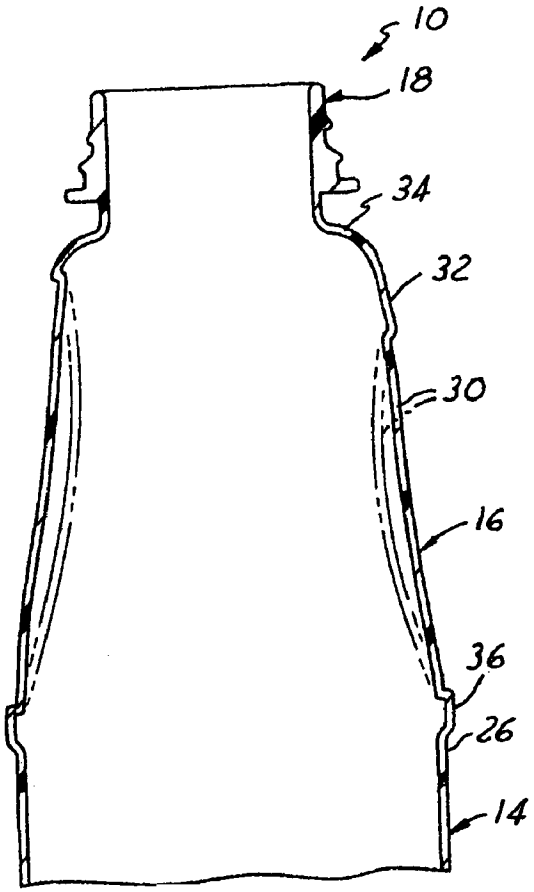
FIGS. 3–8 are fragmentary sectional views taken substantially along the respective lines 3—3 through 8—8 in FIG. 1.
Figure 4:
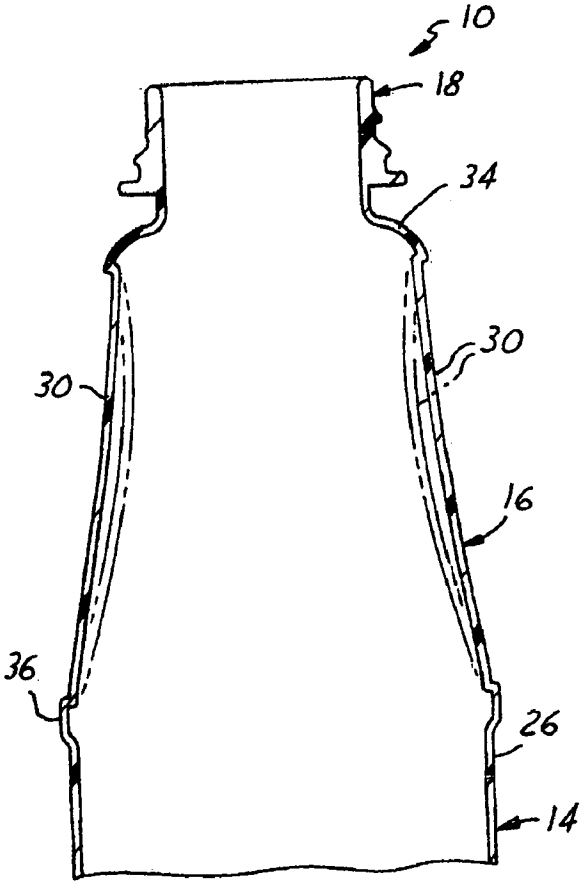
Figure 3:
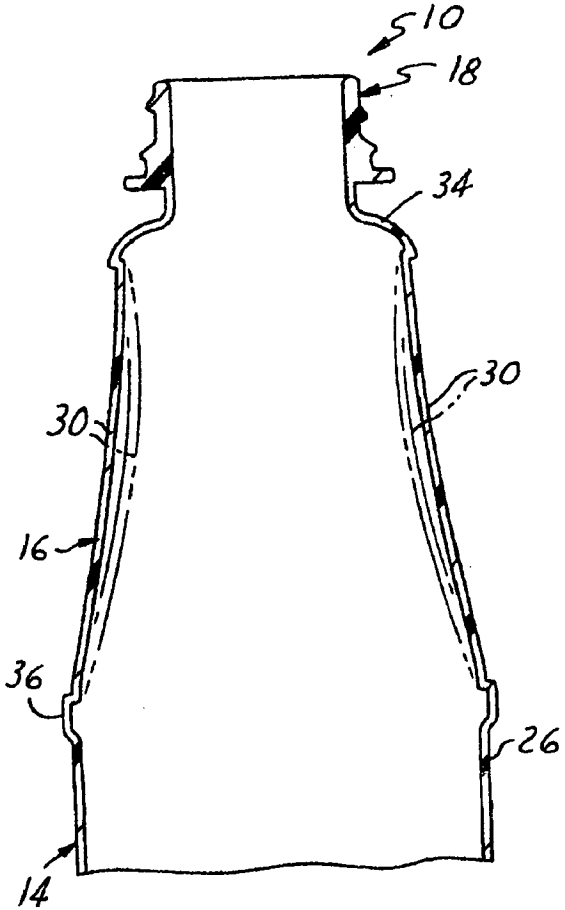
Figure 6:
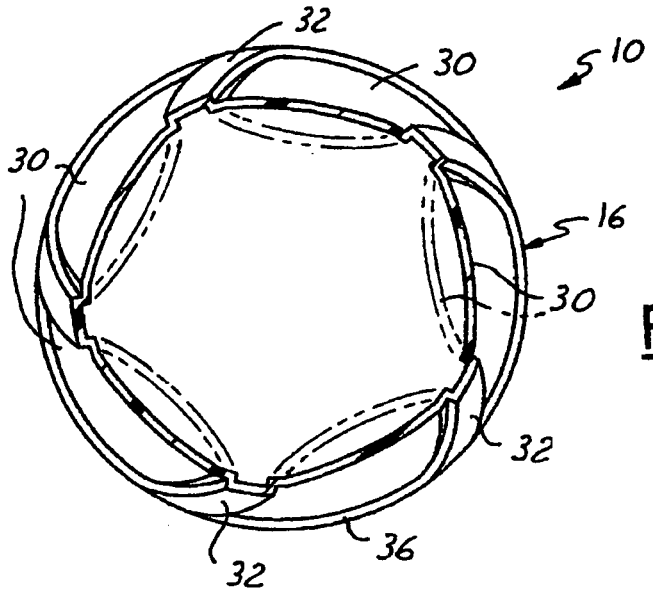
Figure 7:
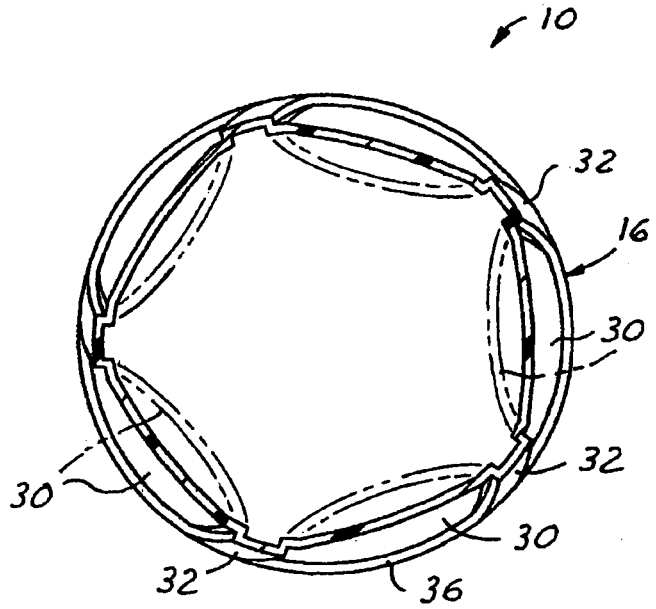
Figure 8:
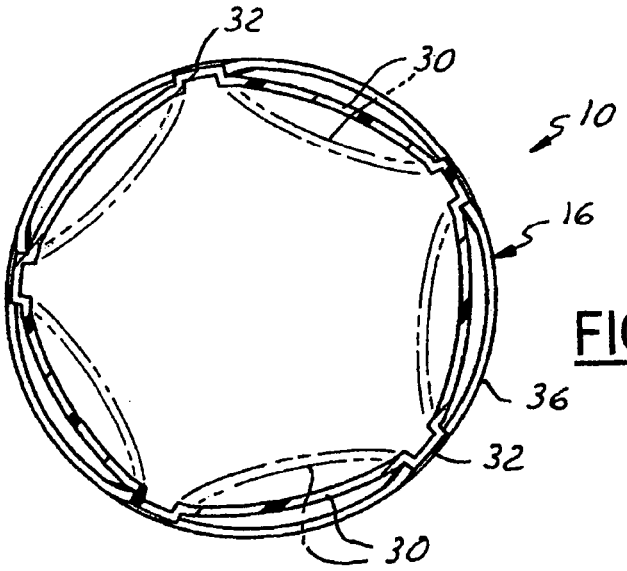

As best seen in FIGS. 3–5, vacuum panels 30 are bowed radially inwardly—i.e., are concave from outside of the container—as viewed in lateral cross section—e.g., tangential cross section in a circular container. However, as best seen in FIGS. 6–8 vacuum panels 30 are bowed radially outwardly—i.e., are convex in cross section from outside of the container—as viewed in axial cross section. This vacuum panel geometry enhances the performance of the vacuum panels in absorbing vacuum forces on the container sidewall after filling the container with hot fluid, capping the container and allowing the container and fluid product to cool. That is, this vacuum panel geometry significantly increases vacuum performance in terms of volume reduction from inward movement of the vacuum panels. Inward flexure of panels 30 under vacuum is illustrated in phantom in FIGS. 3–8.

The container of the present invention preferably is blow molded from a preform, such as an extruded tubular preform or, more preferably, an injection or compression molded preform. The dome 16 of the container is of substantially uniform wall thickness. That is, the wall thickness of the dome 16, including both vacuum panels 30 and ribs 32, is of nominally uniform wall thickness, meaning that any thickness variations are due to manufacturing anomalies and/or differential stretching during blow molding. For example, with the tapering dome construction illustrated in FIG. 1, the lower portion of the dome will expand slightly more than the upper portion of the dome during blow molding, so that the lower portion of the dome will have a slightly lesser wall thickness than the upper portion. In the same way, ribs 32 expand outwardly during blow molding slightly more than vacuum panels 30. However, as shown in FIGS. 3–8, the wall thickness of dome 16 is substantially uniform both axially and circumferentially in the dome.

Figure 9:
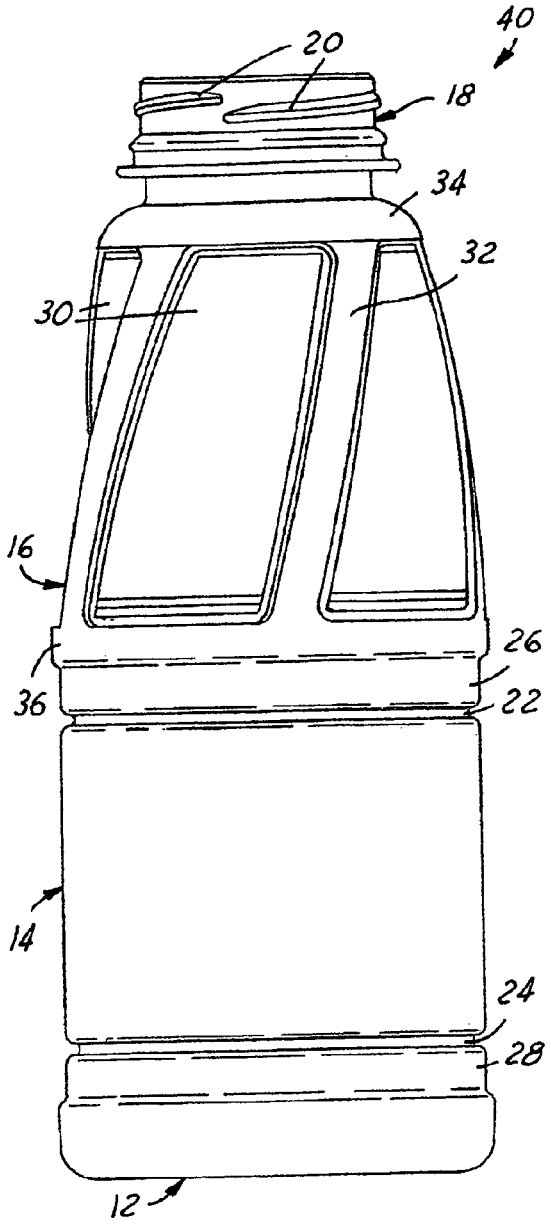
FIGS. 9 and 10 are elevational views of containers in accordance with respective modified embodiments of the invention.

FIG. 9 illustrates a modification 40 to the container of FIGS. 1–8, in which a pair of radially inwardly extending circumferential ribs 22, 24 extend around body 14 adjacent to dome 16 and base 12 respectively. Ribs 22, 24 thus form a pair of axially spaced external cylindrical lands 26, 28 for attachment of a label to body 14.

Figure 10:
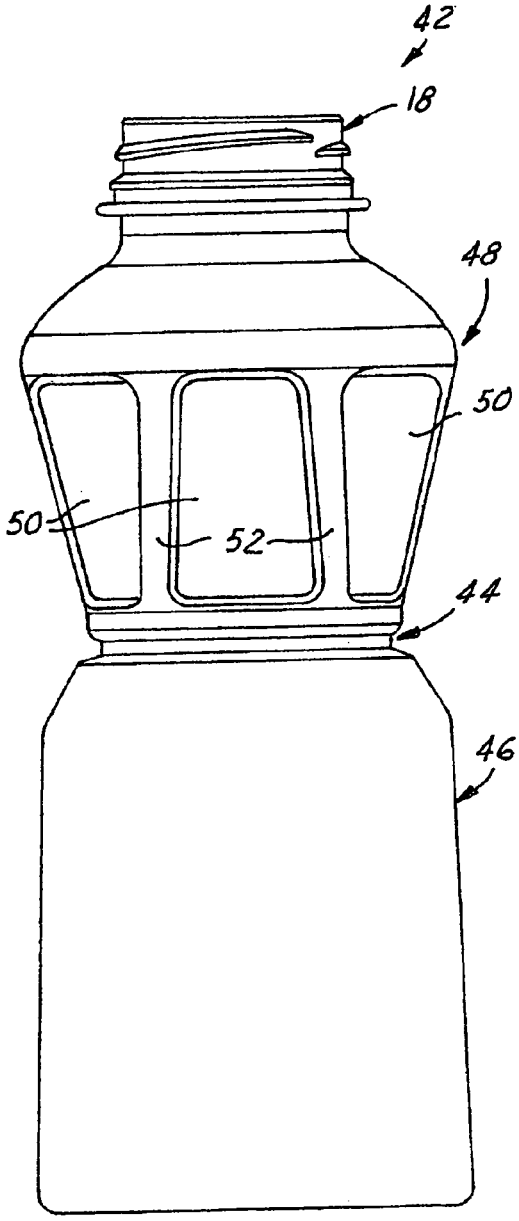

FIG. 10 illustrates a second alternative embodiment 42 of the invention. A waist 44 connects a container body 46 to a dome 48. An angularly spaced circumferential array of vacuum panels 50 are disposed around dome 48. Panels 50 are separated from each other by ribs 52. Vacuum panels 50 are externally concave in lateral cross section and externally convex in axial cross section, as in the embodiments of FIGS. 1–9. The outer surfaces of ribs 52 are on a common conical surface of revolution, and panels 50 are recessed radially inwardly from this surface of revolution. The longitudinal centerlines or axes of the panels are coplanar with the container axis, rather than at a lateral angle to the container axis as in the embodiments of FIGS. 1–9.

Container 10 may be of any suitable monolayer or multilayer plastic construction, such as polyester (e.g., polyethylene terephthalate (PET) or polyethylene terephthalate glycol (PETG) or polyethylene naphthalate (PEN)), or polyolefin (e.g., polypropylene (PP) or polyethylene (PE)).

There have thus been disclosed a hot-fill plastic container and a method of manufacture that fully satisfy all of the objects and aims previously set forth. The invention has been disclosed in conjunction with a presently preferred embodiment thereof, and a number of modifications and variations have been discussed. Other modifications and variations will readily suggest themselves to persons of ordinary skill in the art. For example, although five vacuum panels are illustrated in the preferred embodiment, a greater or lesser number of vacuum panels could be employed, such as six or four. The container dome could be other than tapering, such as cylindrical, preferably being generally round in cross section perpendicular to the container axis. The vacuum panels could be positioned in the body portion or the base portion of the container. For example, the container could be a rectangular container, and the concave/convex vacuum panels in accordance with the broadest aspects of the present invention could be disposed on the short walls of the rectangular body portion of the container. The invention is intended to embrace all such modifications and variations that fall within the spirit and broad scope of the appended claims.

The invention claimed is:

1. A blow molded plastic hot-fill container, comprising:

a plurality of vacuum panels for inward flexure under vacuum, wherein each said vacuum panel is, over a majority of its surface, externally concave as viewed in cross section from a first direction and externally convex as viewed in cross section from a second direction orthogonal to said first direction; and a plurality of circumferentially spaced ribs forming a spiral pattern, each of the ribs having a first edge and a second edge circumferentially spaced from the first edge, the first and second edges being substantially parallel to each other, wherein said vacuum panels are separated from each other by the circumferentially spaced ribs.

2. The container set forth in claim 1 wherein said container has a sidewall extending from a base to a neck finish, and wherein said vacuum panels are disposed in said sidewall.

3. The container set forth in claim 1 including a base for supporting the container, a body extending from said base, a dome extending from said body and a neck finish extending from said dome, wherein said vacuum panels are disposed in said dome.

4. The container set forth in claim 2 wherein said sidewall, including said vacuum panels, is of generally uniform wall thickness.

5. The container set forth in claim 4 wherein said vacuum panels are uniformly spaced around an axis of said container.

6. The container set forth in claim 1 wherein said ribs have external surfaces on a common surface of revolution, and wherein said vacuum panels are recessed radially inwardly from said surface of revolution.

7. A blow-molded plastic hot-fill container, comprising:

a base for supporting the container, a body extending from said base, a dome extending from said body and a neck finish extending from said dome, wherein said dome includes an array of vacuum panels, each of said vacuum panels being, over a majority of its surface, externally concave as viewed in cross section from a first direction and externally convex as viewed in cross section from a second direction orthogonal to said first direction, said dome includes a plurality of circumferentially spaced ribs forming a spiral pattern, each of the ribs having a first edge and a second edge circumferentially spaced from the first edge, the first and second edges being substantially parallel to each other, and said vacuum panels are separated from each other by the circumferentially spaced ribs.

8. The container set forth in claim 7 wherein said vacuum panels are externally concave in cross section as viewed tangentially of said dome and externally convex in cross section as viewed axially of said dome.

9. The container set forth in claim 7 wherein said dome, including said array of vacuum panels, is of generally uniform wall thickness.

10. The container set forth in claim 7 wherein said ribs are connected to annular rings that encircle said dome above and below said vacuum panels, wherein said ribs have external surfaces on a common surface of revolution, and wherein said vacuum panels are recessed radially inwardly from said surface of revolution.

11. A blow-molded plastic hot-fill container, comprising:

a base for supporting the container, a body extending from said base, a dome extending from said body and a neck finish extending from said dome, wherein said dome includes an array of flexible resilient vacuum panels separated from each other by circumferentially spaced ribs, each of said vacuum panels is, over a majority of its surface, externally concave as viewed in cross section from a first direction and externally convex is viewed in cross section from a second direction orthogonal to said first direction, the circumferentially spaced ribs form a spiral pattern, each of the ribs having a first edge and a second edge circumferentially spaced from the first edge, the first and second edges being substantially parallel to each other, and said dome, including said array of vacuum panels, is of generally uniform wall thickness and circular in cross section.

12. The container set forth in claim 11 wherein said vacuum panels are externally concave in cross section as viewed tangentially of said dome and externally convex in cross section as viewed axially of said dome.

13. The container set forth in claim 11 wherein said ribs are connected to annular rings that encircle said dome above and below said vacuum panels, wherein said ribs have external surfaces on a common surface of revolution, and wherein said vacuum panels are recessed radially inwardly from said surface of revolution.

14. A method of making a hot-fill plastic container that includes a step of blow molding a container having a plurality of vacuum panels for inward flexure under vacuum, wherein said vacuum panels are, over a majority of their surface, externally concave as viewed in cross section from a first direction and externally convex as viewed in cross section from a second direction orthogonal to said first direction, said vacuum panels are separated from each other by circumferentially spaced ribs, and the circumferentially spaced ribs form a spiral pattern, each of the ribs having a first edge and a second edge circumferentially spaced from the first edge, the first and second edges being substantially parallel to each other.

15. A container made in accordance with the method set forth in claim 14.

16. A method of making a hot-fill plastic container that includes the step of blow molding a container having a base for supporting the container, a body extending from said base, a dome extending from said body and a neck finish extending from said dome, wherein said dome includes an array of vacuum panels, each of said vacuum panels being, over a majority of its surface, externally concave as viewed in cross section from a first direction and externally convex as viewed in cross section from a second direction orthogonal to said first direction, said vacuum panels are separated from each other by circumferentially spaced ribs in said dome, and the circumferentially spaced ribs form spiral pattern, each of the ribs having a first edge and a second edge circumferentially spaced from the first edge, the first and second edges being substantially parallel to each other.

17. The method set forth in claim 16 wherein said container is blow molded from a preform.

18. The method set forth in claim 17 wherein said vacuum panels are externally concave in cross section as viewed tangentially of said dome and externally convex in cross section as viewed axially of said dome.

19. The method set forth in claim 17 wherein said dome, including said array of vacuum panels, is of generally uniform wall thickness.

20. A molded plastic container made in accordance with the method set forth in claim 17.

21. The method set forth in claim 16 wherein said ribs are connected to annular rings that encircle said dome above and below said vacuum panels, wherein said ribs have external surfaces on a common surface of revolution, and wherein said vacuum panels are recessed radially inwardly from said surface of revolution.

22. A molded plastic container made in accordance with the method set forth in claim 16.

* * * * *